US006852951B2

(12) United States Patent
Heise

(10) Patent No.: US 6,852,951 B2
(45) Date of Patent: Feb. 8, 2005

(54) HEATING APPARATUS AND SYSTEM USING SUCH APPARATUS

(76) Inventor: Lorne Heise, RR #2, Minden, Ontario (CA), K0M 2K0

( * ) Notice: Subject to any disclaimer, the term of this patent is extended or adjusted under 35 U.S.C. 154(b) by 0 days.

(21) Appl. No.: 10/355,212

(22) Filed: Jan. 31, 2003

(65) Prior Publication Data

US 2003/0213796 A1 Nov. 20, 2003

Related U.S. Application Data

(60) Provisional application No. 60/352,598, filed on Jan. 31, 2002.

(51) Int. Cl.[7] ..... H05B 1/00
(52) U.S. Cl. ..... 219/213; 219/535; 219/540
(58) Field of Search ..... 219/213, 535, 219/530, 540

(56) References Cited

U.S. PATENT DOCUMENTS

| | | | | | |
|---|---|---|---|---|---|
| 3,331,946 | A | * | 7/1967 | Bilbro | 219/535 |
| 3,388,738 | A | * | 6/1968 | Dery | 165/47 |
| 3,725,638 | A | * | 4/1973 | Solin et al. | 219/213 |
| 4,081,657 | A | * | 3/1978 | Stanford | 219/213 |
| 4,134,002 | A | * | 1/1979 | Stanford | 219/213 |
| 5,391,858 | A | * | 2/1995 | Tourangeau et al. | 219/213 |

* cited by examiner

*Primary Examiner*—Robin O. Evans
*Assistant Examiner*—Vinod Patel
(74) *Attorney, Agent, or Firm*—John R.S. Orange; Santosh K. Chari; Sean X. Zhang

(57) ABSTRACT

Heating apparatus comprising a body of conducting material having oppositely directed surfaces extending between the edges, a channel formed one of the surfaces and defined by a pair of walls upstanding from the one surface, and a cover cooperating with the walls to define an enclosed passageway to receive a heating cable.

13 Claims, 5 Drawing Sheets

FIG. 3.
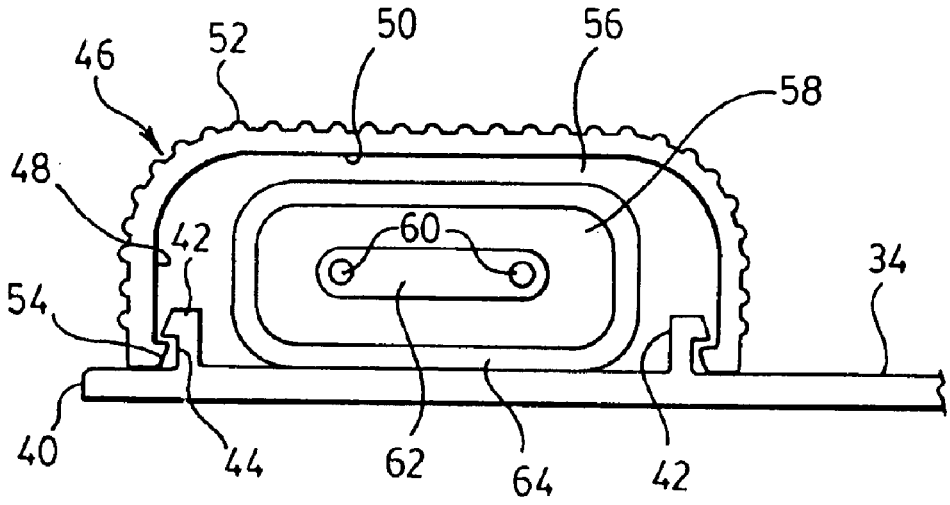
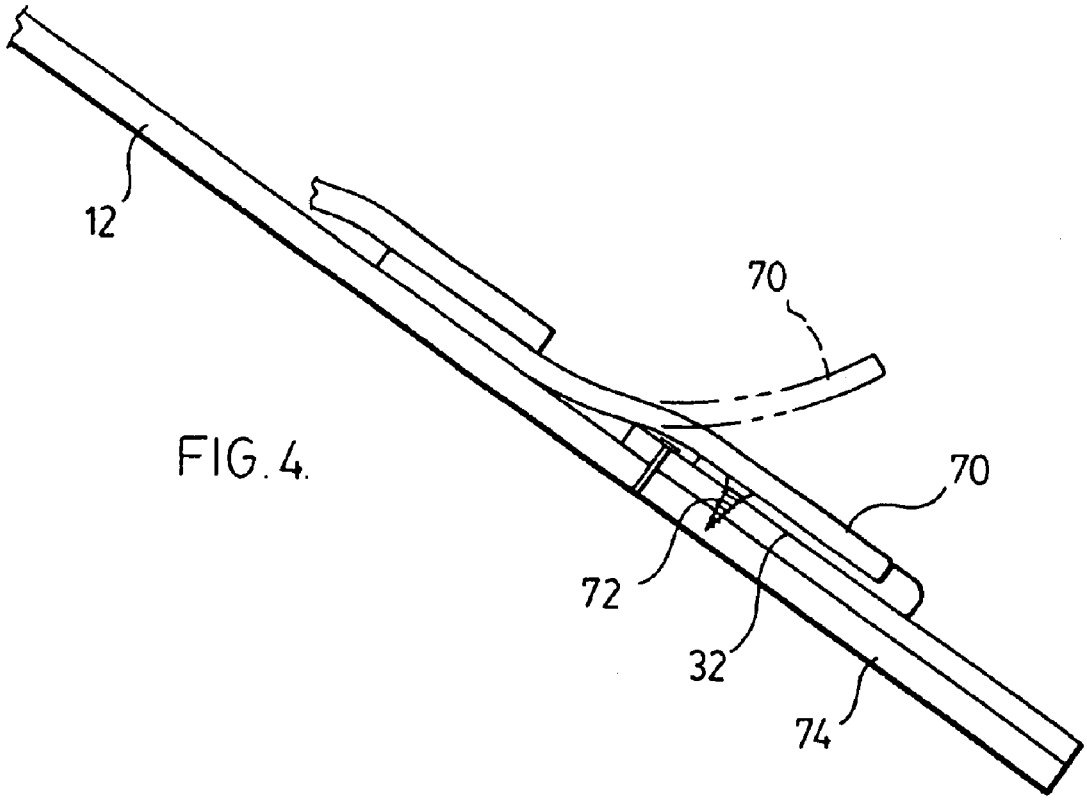
FIG. 4.

HEATING APPARATUS AND SYSTEM USING SUCH APPARATUS

The application claims priority from U.S. Provisional Application No. 60/352,598, filed Jan. 31, 2002.

FIELD OF THE INVENTION

The present invention relates to heating apparatus and systems using such apparatus.

BACKGROUND OF THE INVENTION

It is well known that ice build up on planar surfaces such as roofs may cause physical damage to the structure and also pose a hazard to people passing near to such structures. Typically the build up of ice and snow on a building is caused by localised freeze and thaw cycles that generates an ice dam at a particular locations along the roof These ice dams prevent the drainage of the roof and may cause penetration of moisture through the roof if left unattended.

It is known to provide localised heating at the edge of the roof by a heating cable secured to the roof by clips. The heating cable can be activated to melt any accumulation of ice and snow that may occur on the edge of the roof. With such installations, the cable is left relatively exposed and the effect of the heating cable is localised. For this reason a serpentine installation is frequently used to extend the area over which heat is applied.

However the heating effect achieved from the cable is relatively local and leaves the cable exposed to damage from the snow, ice and other external factors.

It is therefore an object of the present invention to provide a heating apparatus to obviate or mitigate the above disadvantages.

In general terms, the present invention provides heating apparatus comprising a body of conducting material having a pair of laterally spaced edges, oppositely directed surfaces extending between said edges, a channel formed on one of the surfaces and defined by a pair of walls upstanding from said one surface, and a cover co-operating with the walls to define an enclosed passageway to receive a heating cable.

BRIEF DESCRIPTION OF THE DRAWINGS

Embodiments of the invention will now be described by way of example only with reference to the accompanying drawings in which:

FIG. 3 is an enlarged view of a portion of the heating apparatus shown in FIG. 2;

FIG. 4 is a side view of the heating apparatus of FIGS. 2 and 3 installed on a roof of the house of FIG. 1;

DESCRIPTION OF THE PREFERRED EMBODIMENTS

Figure 1:
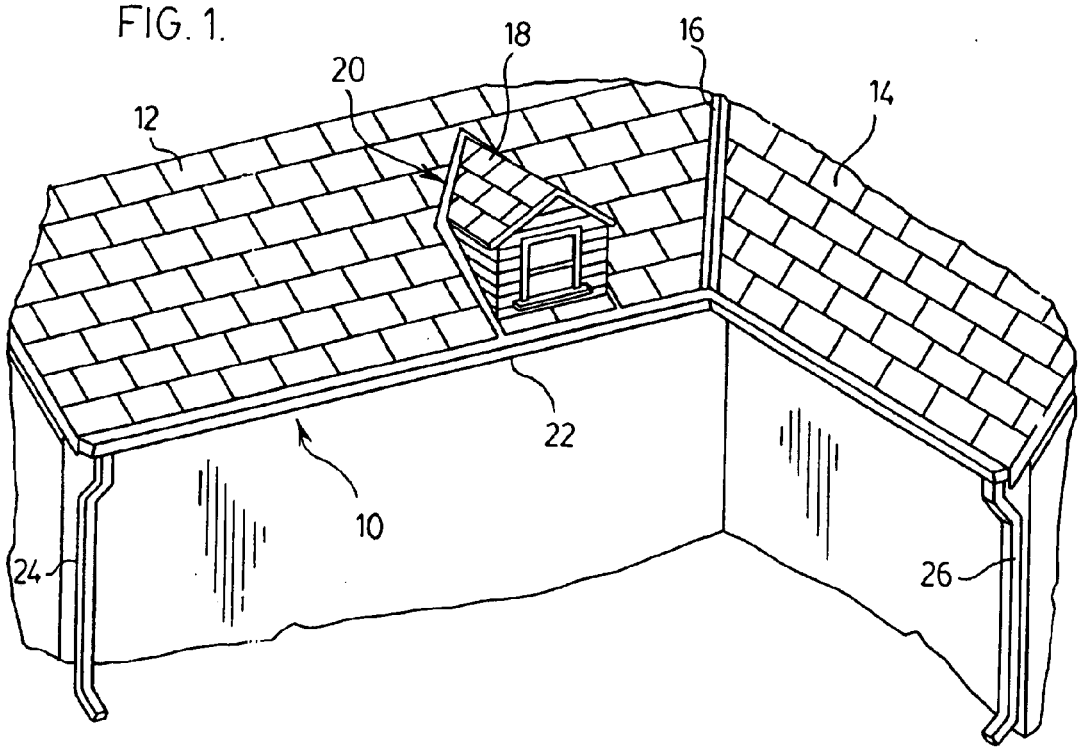
FIG. 1 is a perspective view of a house.

Referring therefore to FIG. 1, a house 10 has a roof 11 formed in part by a pair of intersecting roof panels 12, 14 which define a valley 16 at their intersection. A dormer window 18 is located in the roof to define further valleys 20 at its intersection with the plane of the roof 12. An eavestrough 22 extends around the lower periphery of the roof and has a pair of down spouts 24, 26 to convey water from the eavestrough 22 to the ground.

A number of areas on the roof 11 of house 10 pose a significant risk of ice build up due to various environmental factors including freeze/thaw cycles or the loss of heat from the house itself. To avoid the ice build up the heating apparatus shown in FIGS. 2 through 11 is utilised on different areas on the house as will be described more fully below.

Figure 2:
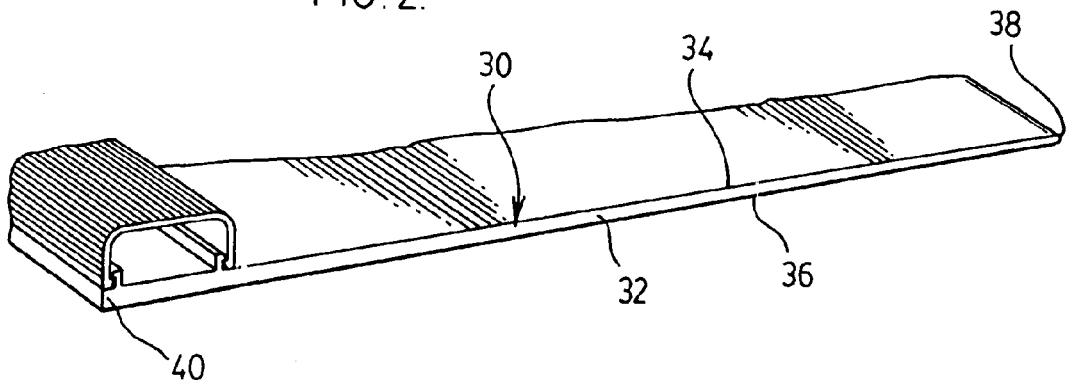
FIG. 2 is a perspective end view of a heating apparatus for installation on the house of FIG. 1.

Referring therefore to FIG. 2, a heating apparatus 30 has an elongate body 32 with upper and lower faces 34, 36. The body 32 extends between a pair of laterally spaced edges 38, 40 and tapers from a tip 38 to a butt end 40 such that the spacing between the surfaces 34, 36 progressively increase from the tip 38 to the butt end 40. As can be seen more clearly in FIG. 3, a pair of upstanding barbs 42 are integrally formed adjacent the butt end 40 on the upper surface 34. The barbs 42 are undercut as indicated at 44 to allow a cap 46 to be secured to the body 32.

The cap 46 is generally D-shaped with a pair of limbs 48 extending from an intermediate portion 50. The outer surface of the cap 46 is ribbed as indicated at 52 to increase the surface area of the outer surface of the cap. The lower end of the limbs 48 have barbs 54 complimentary to the undercut 44. Each of the barbs 42, 54 are shaped to permit the cap 46 to be engage with and be snapped onto the barb 44 to retain the cap on the body 32.

The cap 46 and body 32 co-operate to define a cavity 56 within which is located a heating cable 58. The heating cable 58 is of known design and is of a self regulating construction with a pair of conductors 60 electrically connected by a carbon filament 62. The cable includes a protective outer sheath 64 and operates to provide a heating effect that is proportional to the ambient temperature. Thus the lower the temperature from a pre-set meld point the greater the heating effect. Such a cable is well known and is available from Heat-Line Corporation, Canarvon, Ontario under the trademark Paladin I.

The body 32 and cap 46 are formed from a highly conductive material, typically aluminium. The body 32 is dimensioned to coincide with the dimensions of courses of shingle applied to the roof panels 12 and 14. In a typical application, the body 32 is in the order of 6.65 inches from the tip 38 to the butt end 40 with the barb 42 closest to the tip 38 spaced 0.7 inches from the butt end 40. The length of the body 32 may be of any convenient length, typically 4 foot lengths and the thickness of the body 32 at the butt end 40 is in the order of 0.1 of an inch. The cavity 56 will typically be in the order of 0.65 inches between the barbs and in the order of 0.25 deep. These dimensions are of course typical and may vary according to particular applications or physical dimensions. Typically the body 32 and cap 46 may be extruded and subsequently cut to length to suit. A suitable aluminium alloy is 6063 T5 although other alloys may be utilised. The outer surfaces 34, 36 of the body 38 may be covered by barrier materials such as Mylar to inhibit galvanic corrosion when used in combination with metal roofing or fastenings.

The apparatus 30 is installed on the roof panel 12 at a location proned to ice build up. As indicated in FIG. 4, this may be at a location spaced from the lower edge of the roof panel 12. The apparatus 30 is installed by lifting a shingle 70 to expose the underlying shingle and the body 32 then secured by a screw 72, nail or adhesive or other fastening to the underlying shingle and roof deck 74. The apparatus 30 is positioned so that the cap 46 is adjacent to the lower end of the shingle 70 and will run horizontally along the lower edge of the run of shingles. The shingle 70 may then be replaced to cover the body 38 with the tapered cross-section of the body 38 providing a minimum disturbance to the line of the shingles. After installation, the cable 58 is located between the barbs 42 and the cap 56 then snapped into place. The end of the cable is connected to a suitable power source on the outside of the house and may in fact be fed within the down spouts 24 to provide a heating effect and maintain the down spouts clear of ice.

Sufficient of the apparatus 30 is installed to extend along the roof panel in the area where the ice is likely to form. The apparatus 30 are laid end to end with a small gap between adjacent units to permit contraction and expansion.

In operation, power is supplied to the cable 58 that provides a self regulating heating effect within the channel 56. The heat is transferred through the body 32 beneath the shingle 70 which is in contact with the upper surface 34. The heat is thus transferred over a substantial area through the shingle and into the ice or snow causing it to melt and drain down the roof. As the temperature fluctuates, the heating effect similarly fluctuates and an ice free roof panel is maintained under varying conditions. Naturally, the power source may be used intermittently or may be left in with its self regulation providing economical use of electricity.

Figure 5:
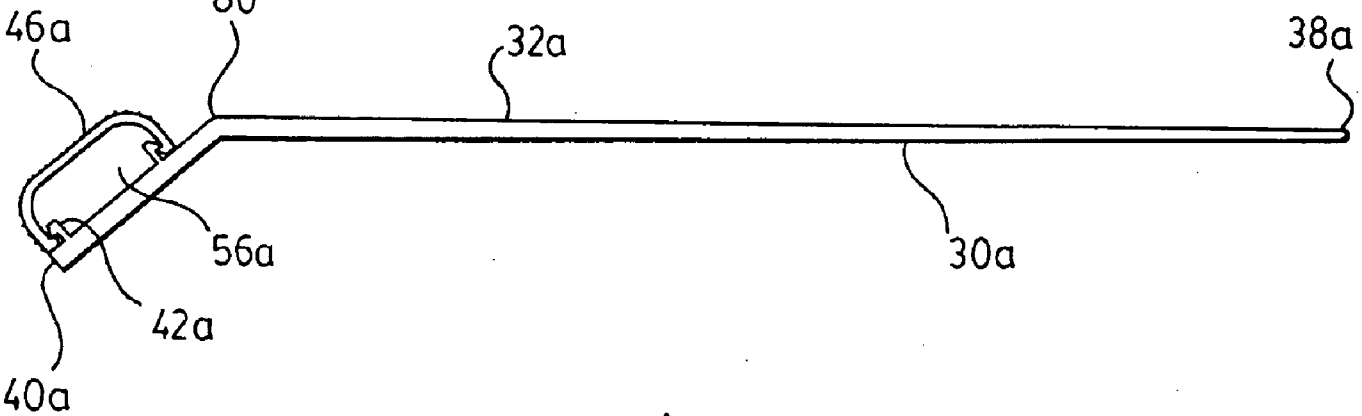
FIG. 5 is a end view similar to FIG. 2 of an alternate embodiment.

As illustrated in FIG. 4, the apparatus 30 is installed away from the edge of the roof panel 12. An alternative embodiment as shown in FIG. 5 is particularly useful for use at the edge of the roof panel and like components will be identified with like reference numerals with a suffix "a" added for clarity. In the embodiment of FIG. 5, the body 32*a* of the apparatus 30*a* is cranked as indicated at 80 between the tip 38*a* and butt end 40*a*. A cap 46*a* is secured on barbs 42*a*. The crank 80 will typically provide an included angle in the order of 140° and is spaced in the order 5.6 inches from the tip 38*a*.

Figure 6:
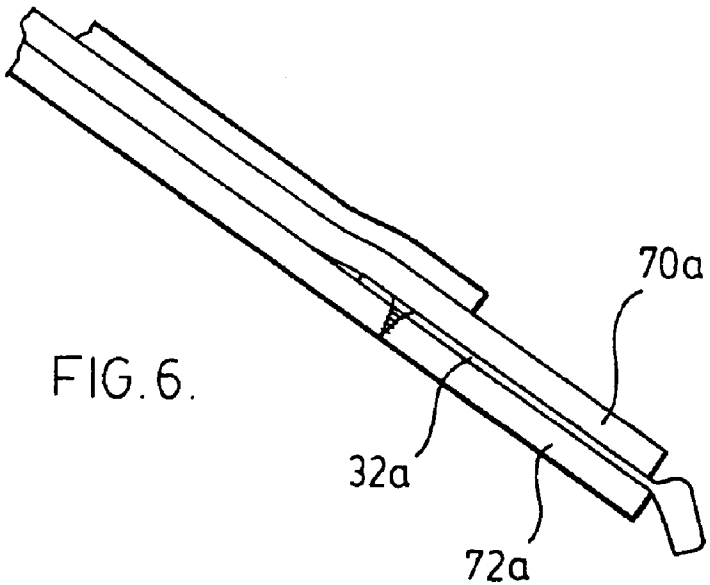
FIG. 6 is a view similar to FIG. 4 utilising the embodiment of FIG. 5.

The heating apparatus 30*a* is installed in the manner shown in FIG. 6 is similar to the shown in FIG. 4. The body 32*a* is located beneath the first run of shingles 70*a* with the crank 80 located on the edge of the sheathing 72*a*. The chamber 56*a* thus depends below the lower edge of the shingles and provides a heating effect at the edge of the roof panel 12 which is transferred through the body 32*a* into the lower most run of the shingles 80*a*. Again the broad band effect of the heating enables the lower edges of the roof panel to be maintained free of ice and the cable 58*a* located securely within the channel 56*a* below the sight line of edge of the roof 11.

Figure 7:
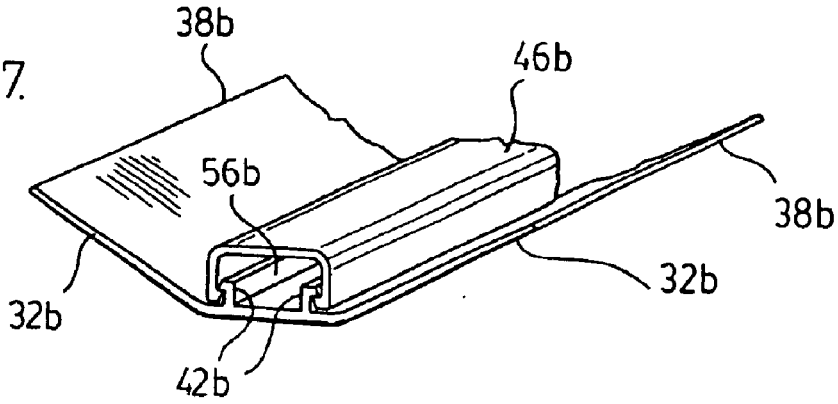
FIG. 7 is a perspective view of a further embodiment of heating apparatus.
Figure 8:
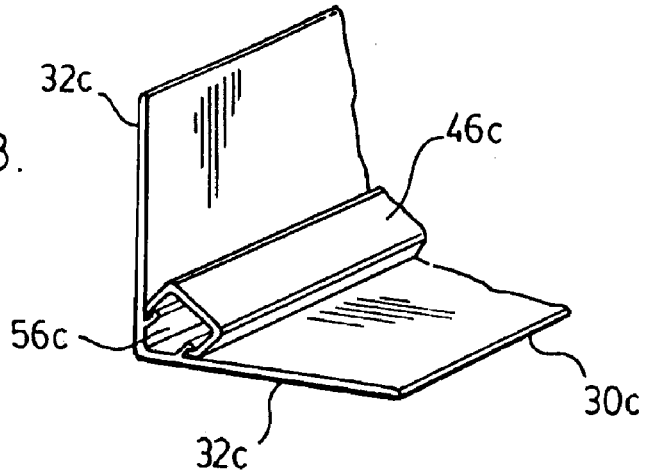
FIG. 8 is a perspective view of a still further embodiment of the apparatus.

The valley areas 16, 20 are also susceptible to the build up of ice and the embodiments shown in FIGS. 7 and 8 are useful in these locations. Again like components will be identified with like reference numerals with a suffix "b" and "c" respectively provided for clarity. In FIG. 7, the body 32*a* extends on either side of the cap 46*b* and is cranked to provide an inclination corresponding to the included angle in the valley 16. The relatively malleable nature of the aluminium alloy facilitates the adjustment of the inclination so as to match the included angle with each of the bodies 32*b* tapering towards their tips 38*b*. The cap 46*a* is secured as a snap fit on barbs 42*b* so that the heating table 58 may pass along the cavity 56*b* along the axis of the valley 16. Thus heat is transferred through the bodies 32*b* into the adjacent shingles as well as the valley itself to promote the thawing of ice build up in that location.

The embodiment of FIG. 8 is particularly useful in the valleys 20 where walls may intersect at 90°. Bodies 32*c* extend from either side of a channel 56 formed between the cap 46*b* and an apex defined by the intersection defined by the bodies 32*c*. Barbs 42*c* project upwardly from each of the bodies 32*c* to allow a snap fit of the cap 46*c*. The unit 30*c* may thus be fitted adjacent the walls in the valleys 20 to provide a heating effect on the lower edge of the wall and the adjacent shingles.

Figure 9:
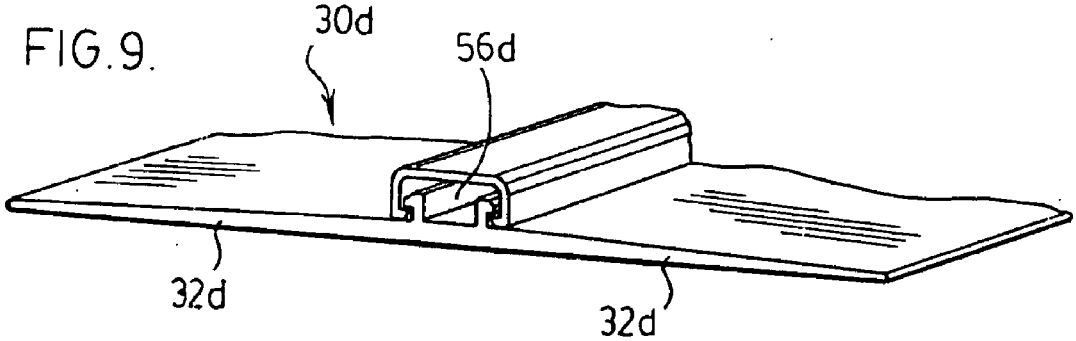
FIG. 9 is a perspective view of a further embodiment of the apparatus.

In a further embodiment shown in FIG. 9, the body 32*d* extends to either side of the channel 56*d* but is essentially planar so it may be fitted to a horizontal surface such as a flat roof to provide drainage channels. The unit 30*d* is particularly useful in maintaining eavestroughs clear of ice, particularly the wide eavestroughs found on commercial and industrial buildings.

Figure 10:
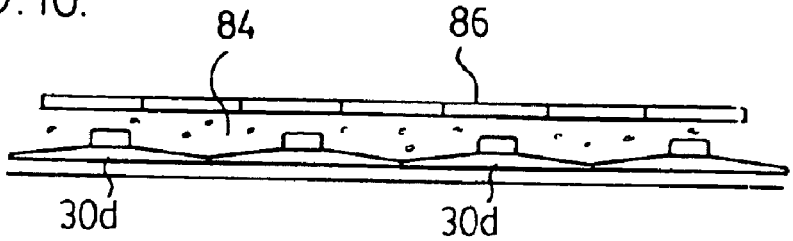
FIG. 10 is a schematic representation of an alternative use of the apparatus shown in FIG. 9.

The embodiment of FIG. 9 may also be used to provide a heating effect to walkways or floors by being placed side by side as shown in FIG. 10 beneath the floor. The apparatus 30*d* is embedded within a mortar 84 and capped with a wear surface 86. The cables may then be run through the channels 56*d* with the bodies 32*d* distributing the heating effect over a wide area through the mortar and to the overlay 86.

Figure 11:
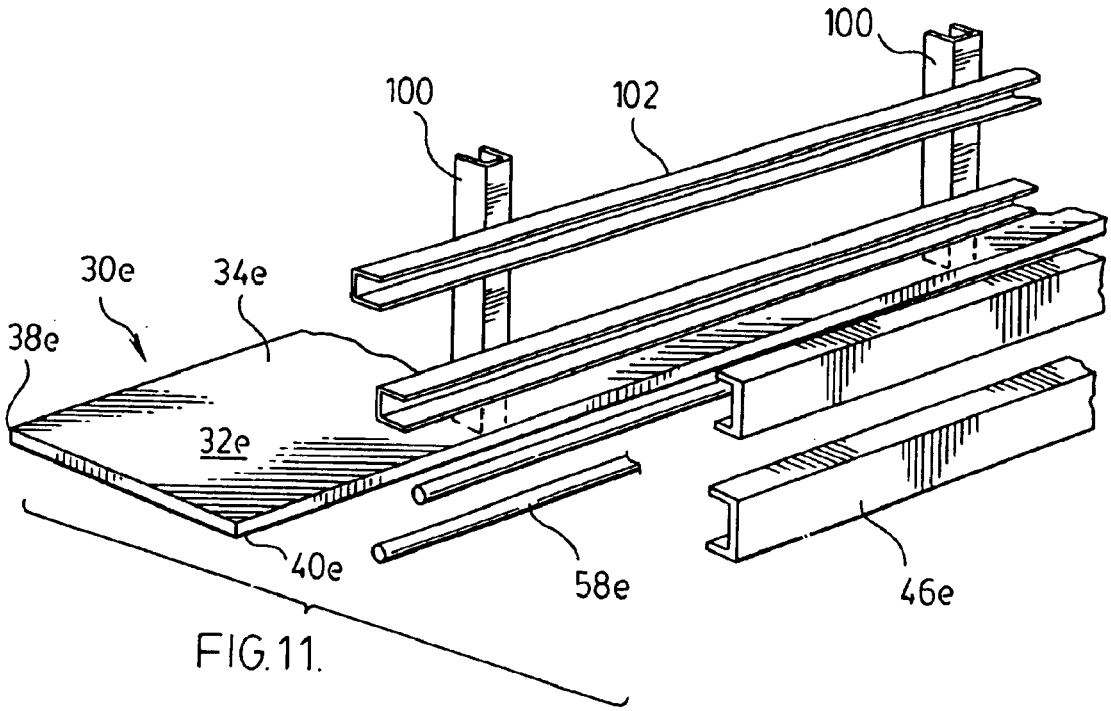
FIG. 11 is a perspective view of a further embodiment of the heating apparatus.

The heating effect of the cables 56 may also be incorporated into a snow fence for use on roofs as indicated in FIG. 11. Snow fences are used to inhibit the discharge of snow from roofs en masse. As shown in FIG. 11, a heating apparatus 30*e* includes a body 32*e* extending from a tapered tip 38*e* to the butt end 40*e*. A pair of supports 100 extend upwardly from the upper surface 34*e* adjacent the butt end 40*e*. The supports 100*e* carry a pair of channel members 102 extending horizontally parallel to the butt end 40*e*. The channels include a pair of barbs to receive a cap 46*e* and define an enclosed channel. The cable 58*e* is located within the channel 102 and secured by the cap 46*e*.

Upon application of power, the heat of the cable is transferred through the channel members 102 and supports 100 into the body 32*c*. A controlled discharge of the snow held by the fence provided from the supports 100 in channel members 102 is provided with progressive thawing as the heat is applied through the cables.

Figure 12:
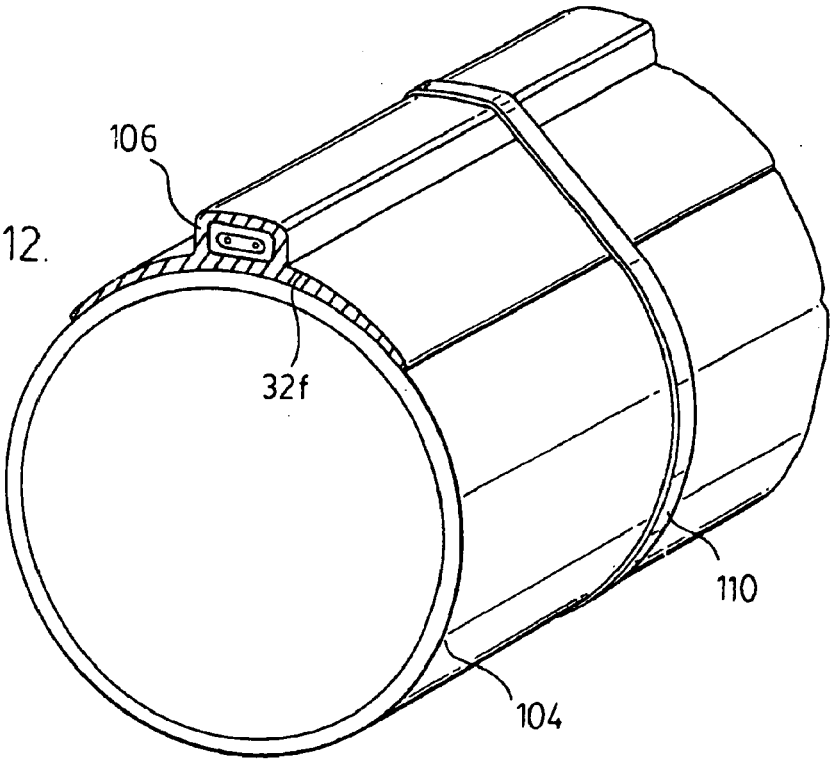
FIG. 12 is a perspective view of a further embodiment applied to a pipe.

In a further embodiment shown in FIG. 12, the heating apparatus 30*f* is used in conjunction with a ductile pipe 104, such as may be used for soil or waste water. As can be seen in FIG. 12, the body 32*f* of the apparatus 30*f* is curved to conform to the outer surface of the pipe 104. A channel 106 is formed on the outwardly directed convex surface to receive a cable 58*f* and is closed by a top cap 46*f*.

The body 32*f* tapers towards the opposite lateral edges and is held in situ by bands 110 or other suitable fasteners. In use, the bodies 32*f* are aligned along the pipe 104 over the area to which the heat is applied. The channels 106 are aligned so the cable may run along the length of the pipe 104 and transfer heat through the body 32*f* to the walls of the pipe 104 over an extended area.

If preferred, the cable may be inserted after the pipe has been buried or covered by using the channel as a race for the cable.

Although the invention has been described with reference to certain specific embodiments, various modifications thereof will be apparent to those skilled in the art without departing from the spit and scope of the invention as outlined in the claims appended hereto.

The embodiments of the invention in which an exclusive property or privilege is claimed are defined as follows:

1. Heating apparatus comprising a body of conducting material having oppositely directed surfaces extending between said edges, a channel formed one of said surfaces and extending between said side edges, said channel being defined by a pair of walls upstanding from said one surface, and a cover detachably secured to said walls and cooperarting with said side walls to define an enclosed passageway to receive a heating cable said surfaces converging from said channel toward an outer edge of said body.

2. Heating apparatus according to claim 1 wherein said surfaces are planar.

3. Heating apparatus according to clam 1 wherein said surfaces are curved.

4. Apparatus according to claim 1 wherein said cover and said walls are provided with interengaging formations to releasably secure said cover to said walls.

5. Apparatus according to claim 4 wherein said cover has a plurality of ribs formed on an outer surface thereof.

6. Apparatus according to claim 1 wherein said body is cranked adjacent one edge of said body and said channel is formed between said one edge and said crank.

7. Apparatus according to claim 6 wherein said surfaces converge from said crank toward the other of said edges.

8. Apparatus according to claim 7 wherein said crank forms an obtuse angle in said body.

9. Apparatus according to claim 1 wherein said channel is located centrally between outer edges of the body and said opposed surfaces extend to either side of said of said channel to define a pair of flanges.

10. Apparatus according to claim 9 wherein said flanges are inclined to one another.

11. Apparatus according to claim 10 wherein said flanges intersect at 90°.

12. Apparatus according to claim 1 wherein said conducting material is selected from the group comprising aluminium or aluminium alloys.

13. Apparatus according to claim 12 wherein a barrier material is applied to at least one of said surfaces to inhibit galvanic corrosion.

* * * * *